United States Patent [19]

Larson

[11] Patent Number: 4,502,517

[45] Date of Patent: Mar. 5, 1985

[54] SAFETY TOOL REST

[76] Inventor: Robert W. Larson, 205 Dartmouth St., Warren, Pa. 16365

[21] Appl. No.: 485,588

[22] Filed: Apr. 15, 1983

[51] Int. Cl.[3] ..... B27C 7/06

[52] U.S. Cl. ..... 142/49

[58] Field of Search ..... 142/49, 48, 50, 55, 142/56, 1; 82/6 R, 6 A, 36 R, 37, 24 R

[56] References Cited

U.S. PATENT DOCUMENTS

| | | | |
|---|---|---|---|
| 57,054 | 8/1866 | Wybell | 142/49 |
| 839,752 | 12/1906 | Guenzler | 142/49 |
| 988,630 | 4/1911 | Diederich | 142/49 |
| 3,405,745 | 10/1968 | Schoonover et al. | 142/1 |
| 4,063,577 | 12/1977 | Tennant | 142/49 |

*Primary Examiner*—Leonidas Vlachos

*Attorney, Agent, or Firm*—Larson and Taylor

[57] ABSTRACT

A safety tool rest for a lathe having a rotating workpiece is disclosed. The tool rest includes a generally planar base which is attachable to the lathe. An elongate flange projects upwardly and outwardly from the base and has an upper edge which is disposed adjacent the rotating workpiece. A tool for cutting the workpiece rests on top of the upper edge of the flange. An elongate bar is attached to the base but is located above the base at a height higher than the upper edge. In this manner, the tool is inserted below the bar and over the upper edge for cutting the workpiece. The tool is prevented from being flipped about the upper edge during contact with the rotating workpiece by the bar. Preferably, the bar is vertically adjustable relative to the base to accommodate different sized tools. This adjustment is provided by two threaded bolts which pass through the bar and engage the base. A spring is provided around the bolts to urge the bar away from the base.

4 Claims, 1 Drawing Figure

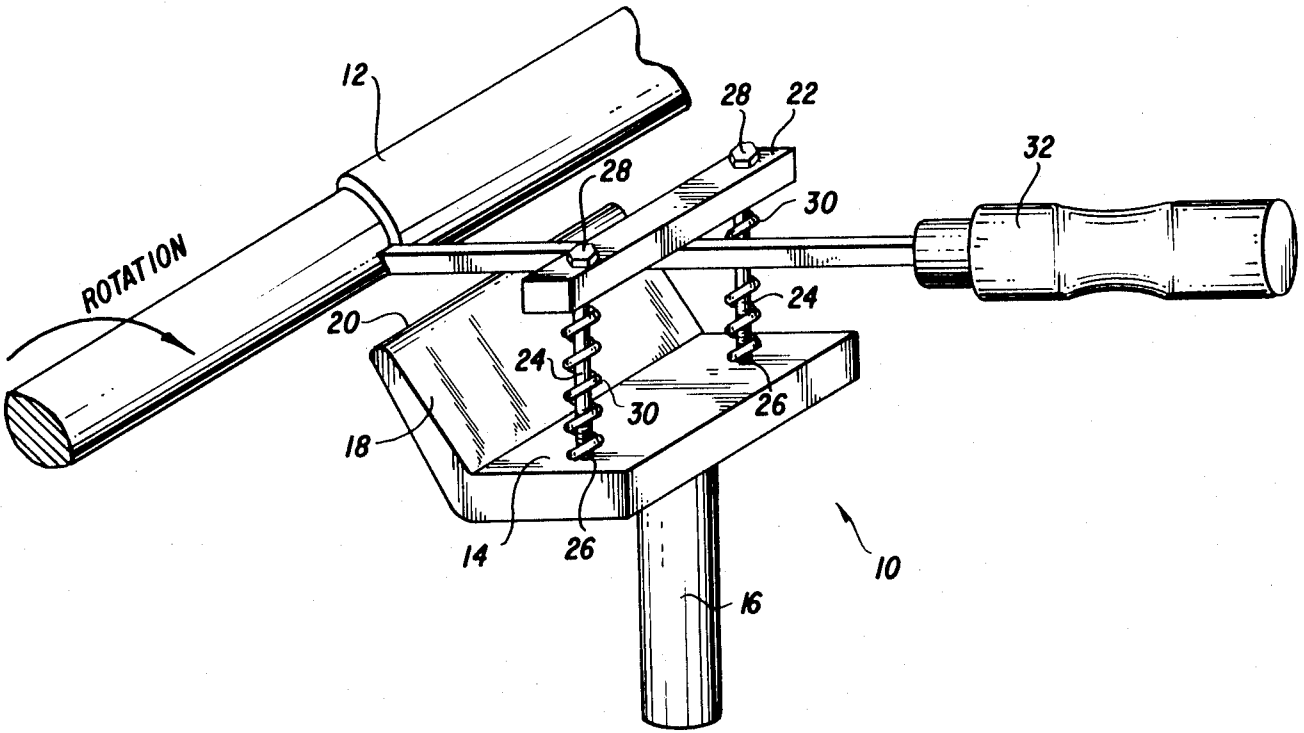
32
10
22
30
24
26
28
16
28
30
26
24
14
12
20
18
ROTATION

SAFETY TOOL REST

FIELD OF THE INVENTION

The present invention relates generally to lathes, and more particularly to a safety tool rest for a lathe.

BACKGROUND OF THE INVENTION

When using a lathe, particularly a wood turning lathe, it is a common practice to place the woodworking tool against a rest located adjacent the workpiece. Typical of these rests is the rest disclosed in U.S. Pat. No. 1,240,474 (Moore et al). The tool rest disclosed in this patent includes an upper edge which is placed adjacent the workpiece and on which the tool rests. The position of the upper edge is adjustable and positionable along the length of the workpiece. However, it has long been recognized that when using a hand tool, there is a danger that the hand tool will be flipped about the upper edge of the tool rest due to too great an engagement with the workpiece. In order to prevent this problem, a tool holder having a cantilevered arm from which an adjustable stop projects has been disclosed in U.S. Pat. No. 2,913,019 (Sprague). This tool holder also has a slot in which the tool rests and any flipping motion about this rest is prevented by the stop.

A wood lathe cutting tool in which the tendency of the tool to flip is substantially eliminated is disclosed in U.S. Pat. No. 4,095,630 (Kirk et al). This tool has the turning force of the workpiece directed substantially perpendicular to a holding base located beneath the workpiece. A relatively flat and long work rest is disclosed in U.S. Pat. No. 850,874 (Tripp).

There are also disclosed in the prior art a number of tool work holders in which the tool is securely attached to a tool rest. Generally, the tool workholder is mechanically adjustable relative to the workpiece. Typical of such tool holders are those disclosed in the following U.S. patents: U.S. Pat. No. 1,036,257 (Kacsmarik); No. 988,630 (Diederich); No. 4,063,577 (Tennant); No. 839,752 (Guenzler); and No. 182,762 (Kinney).

SUMMARY OF THE INVENTION

A safety tool rest for a lathe on which a workpiece is rotating is provided. The tool rest includes a generally planar base which is disposed in a horizontal plane. The planar base includes a connecting means for attaching the base to the lathe. An elongate flange projects outwardly and upwardly from the base. The flange has an upper edge which is disposed adjacent to the rotating workpiece and on which the tool engaging the workpiece normally rests. An elongate bar is attached to the base by an attaching means so that the bar is disposed substantially parallel to the upper edge at a location above the base and at a height higher than the upper edge. In this manner, the tool is freely insertable below the bar to extend out over the upper edge and cut the workpiece. The bar prevents the tool engaging the workpiece from being flipped about the upper edge.

In the preferred embodiment of the present invention, the attaching means for the bar is adjustable so that the bar can be positioned in a vertical direction. Preferably, the attaching means includes two threaded holes having a vertical longitudinal axis in the base and two threaded bolts which engage the bar and which are received in the threaded holes. The bolts pass through the bar and have heads located above the bar so that the bar is freely moveable along the bolts. A spring is then provided about each of the bolts so that the bar is resilently urged away from the base and against the heads of the bolts. Conveniently, the flange and base are integrally formed.

It is a feature of the present invention that a tool rest is provided which prevents the danger of a tool being flipped about the tool rest.

It is an advantage of the present invention that the safety bar is easily adjustable for various sized tools.

It is a further advantage of the present invention that the safety tool rest is easily used by those with little skill, particularly as it is these individuals who are most prone to having a tool flip about a tool rest.

Other features and advantages of the present invention are stated in or apparent from a detailed description of a presently preferred embodiment of the invention found hereinbelow.

BRIEF DESCRIPTION OF THE DRAWING

The single FIGURE is a schematic perspective view of the safety tool rest according to the present invention.

DETAILED DESCRIPTION OF THE PREFERRED EMBODIMENT

With reference now to the drawing in which like numerals represent like elements, a safety tool rest 10 for use with a lathe is depicted. Shown adjacent to tool rest 10 is a rotating workpiece 12 which is mounted on a lathe (not shown). Tool rest 10 includes a base 14 to which a post 16 is attached. Post 16 serves as a mounting means which is suitably received in a mounting bracket (not shown) provided with the lathe which is adjustable relative to workpiece 12.

Base 14 is generally located in the horizontal plane and has a flange 18 projecting upwardly and outwardly away from base 14. Flange 18 includes an upper edge 20 which is disposed adjacent and parallel to workpiece 12.

Located above base 14 is a safety bar 22. Bar 22 extends generally parallel to upper edge 20 of flange 18 and is located at a height vertically above that of upper edge 20. Bar 22 is attached to base 14 by bolts 24. Bolts 24 are threadedly received in threaded holes 26 provided in base 14. Bolts 24 also pass freely through holes provided in bar 22 with heads 28 of bolts 24 preventing bar 22 from moving off of bolts 24. Located around bolts 24 between base 14 and bar 22 are helical springs 30. Springs 30 urge bar 22 upwards in engagement with heads 28 of bolts 26.

In operation, safety tool rest 10 functions in the following manner. Initially, post 16 is received in a suitable mounting bracket provided with the lathe. This mounting bracket is adjusted so that upper edge 20 of tool rest 10 is disposed adjacent and parallel to workpiece 12. Safety bar 22 is then adjusted vertically with respect to base 14 by rotating bolts 24. Safety bar 22 is adjusted so that a suitable cutting tool 32 is insertable beneath bar 22 and rests on top of upper edge 20.

With cutting tool 32 inserted in tool rest 10 as shown, the tip of cutting tool 32 engages workpiece 12 as workpiece 12 rotates. Due to this contact with workpiece 12, cutting tool 32 is urged to pivot about upper edge 20 and flip over workpiece 12. Normally, the user holding cutting tool 32 prevents this flipping motion. However, occasions arise, particularly where a novice is using the lathe, where cutting tool 32 is subject to an extraordinary force urging cutting tool 32 to flip about upper edge 20 and out of the hands of the user. With the present invention, when this flipping motion occurs, cutting tool 32 is restrained by bar 22 from flipping around upper edge 20.

It should be appreciated that the use of the tool rest 10 with safety bar 22 does not interfere with the normal cutting of workpiece 12 with cutting tools 32. The height of safety bar 22 above base 14 is easily adjustable for different sized cutting tools 32, and can be adjusted with a sufficient amount of clearance to allow for some pivoting movement about upper edge 20 if desired for the cutting of workpiece 12. However, safety bar 22 remains capable of preventing cutting tool 32 from being forceably flipped about upper edge 32.

Besides the adjustment of safety bar 22 on bolt 24, it should be appreciated that other suitable adjustment means are also possible.

Thus, although the present invention has been described with respect to an exemplary embodiment thereof, it will be understood by those of ordinary skill in the art that variations and modifications are possible within the scope and spirit of the invention.

I claim:

1. A safety tool rest for a lathe having a rotating workpiece comprising:

a generally planar base disposed in a horizontal plane;

connecting means attached to said base for connecting said base to the lathe;

an elongate flange projecting outwardly and upwardly from said base, said flange having an upper edge which is disposed adjacent the rotating workpiece and on which a tool engaging the workpiece rests, said upper edge of the flange having a length substantially greater than the width of the tool whereby the tool may be moved along the length of the flange;

an elongate bar;

attaching means for attaching said elongate bar to said base, said attaching means including means for supporting said bar such that said bar is disposed substantially parallel to said upper edge at a location above said base and at a height higher than said upper edge of the flange, the elongate bar having a length substantially greater than the width of the tool whereby the tool is freely inserted below said bar and extends out over said upper edge of the flange for cutting the workpiece, said bar preventing the tool from being flipped about said upper edge during contact with the rotating workpiece by engagement between the bar and tool at a point along the length of the tool displaced from the point of engagement between the tool and the upper edge of the flange.

2. A safety tool rest as claimed in claim 1 wherein said attaching means includes two threaded holes in said base having a vertical longitudinal axis, and two threaded bolts engaging said bar which are received in said threaded holes.

3. A safety tool rest as claimed in claim 2 wherein said bolts pass through said bar and have heads located above said bar, and said bar is freely movable along said bolts; and wherein said supporting means further includes a helical spring located about each of said bolts between said base and said bar whereby said bar is resiliently urged away from said base.

4. A safety tool rest as claimed in claim 3 wherein said base and said flange are integrally formed.

* * * * *